US009186716B2

(12) United States Patent
Mašek et al.

(10) Patent No.: US 9,186,716 B2
(45) Date of Patent: Nov. 17, 2015

(54) METHOD OF PRODUCTION OF PRESSED SHEET PARTS WITH INTEGRATED PREPARATION OF BLANKS OF NON-UNIFORM THICKNESS

(71) Applicants: Bohuslav Mašek, Kaznějov (CZ); Hana Jirková, Strakonice (CZ); David Aišman, Plzeň (CZ); Jiři Malina, Most (CZ)

(72) Inventors: Bohuslav Mašek, Kaznějov (CZ); Hana Jirková, Strakonice (CZ); David Aišman, Plzeň (CZ); Jiři Malina, Most (CZ)

(73) Assignee: ZAPADOCESKA UNIVERZITA V PLZNI (CZ)

( * ) Notice: Subject to any disclaimer, the term of this patent is extended or adjusted under 35 U.S.C. 154(b) by 317 days.

(21) Appl. No.: 13/662,188

(22) Filed: Oct. 26, 2012

(65) Prior Publication Data

US 2013/0104616 A1 May 2, 2013

(30) Foreign Application Priority Data

Oct. 27, 2011 (CZ) ..... PV 2011-692

(51) Int. Cl.
*B21D 22/22* (2006.01)
*B21D 22/20* (2006.01)
*B21D 37/16* (2006.01)

(52) U.S. Cl.
CPC ..... *B21D 22/22* (2013.01); *B21D 22/20* (2013.01); *B21B 2205/02* (2013.01); *B21D 37/16* (2013.01)

(58) Field of Classification Search
CPC ..... B21D 22/02; B21D 22/30; B21D 51/26; B21D 22/22; B21D 24/00; B21D 35/00; B60R 2019/1826; B65D 1/165; B65D 1/26
USPC ..... 72/347, 348, 342.1, 342.5, 342.6, 199, 72/240, 160, 161, 350; 428/480, 220, 458, 428/35.7, 463
See application file for complete search history.

(56) References Cited

U.S. PATENT DOCUMENTS

| | | | | |
|---|---|---|---|---|
| 6,615,633 | B1 * | 9/2003 | Akashi et al. | 72/200 |
| 2007/0107203 | A1 * | 5/2007 | Kroger et al. | 29/557 |
| 2011/0094282 | A1 * | 4/2011 | Overrath et al. | 72/342.1 |
| 2012/0074733 | A1 * | 3/2012 | Lenze et al. | 296/203.01 |

FOREIGN PATENT DOCUMENTS

| | | |
|---|---|---|
| WO | 2005/105336 | 11/2005 |
| WO | WO 2005105336 A1 * | 11/2005 |

OTHER PUBLICATIONS

Search Reported dated Jul. 19, 2012 issued in Czech Republic Priority Application No. PV 2011-692 filed Oct. 27, 2011 (4 pages).

* cited by examiner

*Primary Examiner* — Peter DungBa Vo
*Assistant Examiner* — John S Lowe
(74) *Attorney, Agent, or Firm* — Hovey Williams LLP

(57) ABSTRACT

A method of producing pressed metal sheet parts in an integrated process to prepare blanks of non-uniform thickness includes the steps of heating a steel sheet blank in heating equipment to the austenite region of the steel of the sheet steel blank in question, then forming the blank into a flat semi-finished product of non-uniform thickness in forming equipment, then immediately thereafter, without any further hearting of the semi-finished product, deep drawing the semi-finished product in deep drawing equipment into a final spatially shaped part. The method may further include cooling down the final spatially shaped part either during the drawing step or immediately after the deep drawing step in a manner which causes the final spatially shaped part to develop hardening microstructure, which imparts high strength to the final shaped part with non-uniform wall thickness.

2 Claims, 1 Drawing Sheet

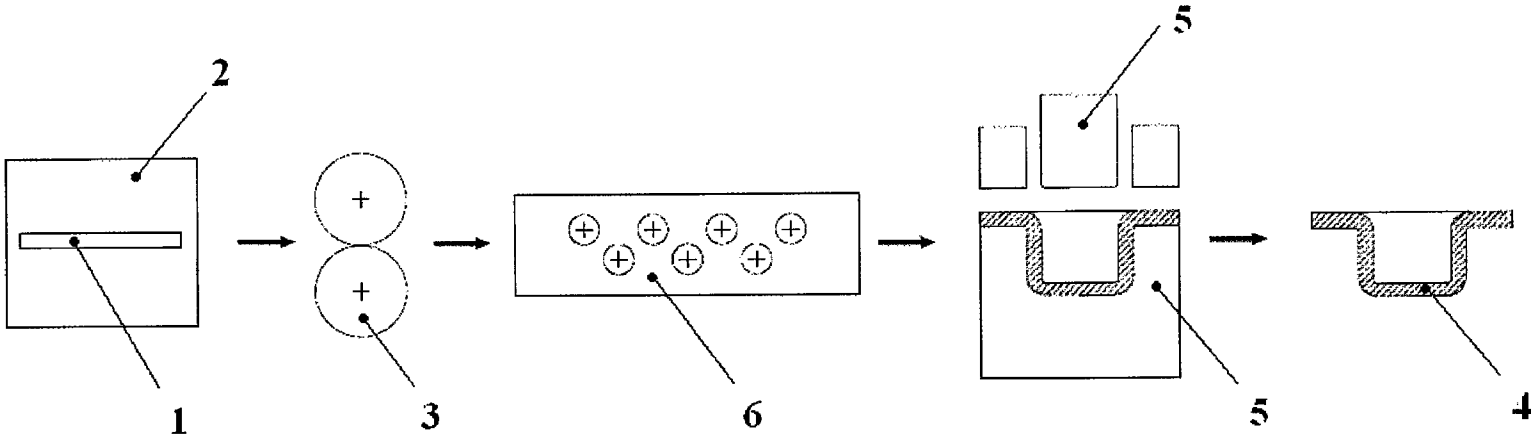
1
2
3
6
5
5
4

METHOD OF PRODUCTION OF PRESSED SHEET PARTS WITH INTEGRATED PREPARATION OF BLANKS OF NON-UNIFORM THICKNESS

BACKGROUND OF THE INVENTION

1. Field of the Invention

The present invention falls in the area of heat treatment and thermomechanical treatment of certain products, in particular deep-drawn sheet metal parts.

2. Description of the Related Art

Spatially shaped parts from metal sheet are typically produced by deep drawing. This procedure is characterized in that a metal sheet with a suitable easy-to-deform microstructure is held by a blank holder and shaped and drawn over the edge of a female drawing die by a male punch. The shape of the product is governed by the shape of the tools. The cold forming process causes the material to work harden. The higher the yield strength of the feedstock, the greater is the springback effect. Springback causes problems with production precision and repeatability. This is why a new hot drawing process was recently developed, which includes hot drawing and press hardening. This process involves processing of metal sheet where the blank is heated to the austenite region, drawn in austenitic condition and, thanks to rapid heat transfer to the female drawing die, cools down between the tools in such a way that hardening microstructure, most often martensite, is obtained in the formed part. This leads to smaller dimensional variation resulting from springback. The typical material used in this application is 22MnB4, the strength of which is about 1,500 MPa after quenching.

It is in particular the safety components in automotive industry which require the highest possible value of the product of strength and elongation in order for the components to be able to absorb as large as possible amount of the impact energy by deforming at high flow stress and without premature instability and fracture failure. These requirements are met in part through suitable engineering design of the components and by the use of metal sheets of dissimilar thickness. Feedstock of this type can be made by welding together sheets of dissimilar thickness, the so-called tailored blanks, or by rolling sheets to obtain variable thickness along the length of the strip. Such sheets are used as blanks for both cold and hot deep drawing. In order to improve the state of the art while keeping or even reducing the resulting weight, the properties of materials need to be improved in a comprehensive manner: particularly enhancing the strength and seeking methods for improving elongation.

SUMMARY OF THE INVENTION

The present invention relates to a method of production of pressed sheet parts with integrated preparation of blanks of non-uniform thickness. This method of production is characterized in that in its first step, a shaped steel sheet blank is heated to the austenite region of the material. Immediately thereafter, the blank is rolled in a way which changes its thickness to specifications for the resulting drawn part. The variation in the blank's thickness can be achieved either by using eccentric tools or by changing the rolling gap in the course of the rolling process. Rolling refines the austenite grain, which may lead to better mechanical properties thanks to fine final microstructure.

In one embodiment, the rolled semiproduct is immediately transferred to a roll straightener where the undesirable wrinkles formed during the forming process in the forming equipment are eliminated. In this embodiment, the semiproduct is then immediately transferred from the roll straightener to a press.

In another embodiment, where the roll straightener is not employed, the semi-finished product is transferred to the press immediately upon rolling.

In the press, the semiproduct with microstructure consisting of undercooled metastable austenite is deep drawn to a shaped part and cooled down in the die, i.e. quenched, immediately afterwards or even during the deep drawing process. By this process, hardening microstructure is obtained, typically martensite.

The finer the martensite particles, the better mechanical properties can be achieved by this procedure. As martensite forms within austenite upon cooling, the resulting microstructure will depend on the austenite grain size, which is favorably conditioned by the deformation introduced during the process employed for changing the thickness of the blank. One substantial aspect of the invention is that the entire process is carried out upon a single heating step. No reheating is involved, which is why grain coarsening is eliminated. In the course of conventional heat treatment, grain size increases during heating and, as a consequence, the size of resulting martensite particles increases.

BRIEF DESCRIPTION OF THE DRAWING

An example embodiment of the proposed invention is described with reference to a drawing in FIG. 1 wherein a sequence of production steps starting with the blank and ending in the final shape of the production part is shown.

DETAILED DESCRIPTION OF AN EMBODIMENT OF THE INVENTION

The method of production of pressed sheet parts with integrated preparation of blanks of non-uniform thickness of the present invention broadly includes the following steps: heating a steel sheet blank 1 in heating equipment 2 to the austenite region of the material. By way of example only to illustrate the invention, the material for the steel sheet blank may be identified by Euronorm steel standards as a 22MnB4 grade steel (Tab. 1). In this example, the heating temperature for the blank 1 is about 910° C. The heating equipment 2 may take the form of a furnace or an induction heating device.

In the second step, the blank 1 is formed in the forming equipment 3, where its thickness is reduced.

The resulting semi-finished product has non-uniform thickness in accordance with specifications for the final part. The forming equipment 3 may include eccentric rolls Immediately after forming in the forming equipment 3, the semi-finished product is straightened in the roll straightener 6 in order to eliminate deviations from the required shape resulting from forming in the forming equipment 3.

The semiproduct is then transferred in to the deep drawing device 5, which in the illustrated embodiment may include a male punch and a female die mounted in a press. The semiproduct is formed by these tools within the undercooled metastable austenite region. The semiproduct may be deep drawn into the final 3D shape 4 at a temperature between about 900° C. and about 420° C. The deep drawing device 5 may be provided with a cooling capability, such as by water, oil or other cooling fluid circulation through a jacket in or surrounding the device or a cooling circuit within the components of the deep drawing device, whereby the final spatially shaped part 4 may be cooled from a temperature within the metastable austenite region to a temperature within the range of about 720° C. to about ambient temperature (typically between about 20° C. to about 30° C.) either during the deep drawing of the semi-finished product or immediately after the drawing step is completed. The material in contact with the tool surface in deep drawing equipment 5 cools down rapidly, which results in hardening microstructure. For example, the hardening structure may be a non-equilibrium structure, which is formed during the very fast cooling from the austenization temperature, such that at least some of the steel of the final 3D shape 4 has a microstructure which may be selected from the group consisting of martensite or bainite or combinations thereof, depending on the cooling rate and level of carbon in the structure. Martinsite and bainite transformations require some level of undercooling. The hardening microstructure causes the final component with non-uniform wall thickness to possess very high strength.

Once the part 4 cools down to ambient temperature, any excess material may be trimmed using, for example, a laser beam.

The example embodiment is shown in FIG. 1

TABLE 1

Chemical composition of the 22MnB4 material in wt. %. The balance consists of iron

| C | Si | Mn | Cr | B |
|---|---|---|---|---|
| 0.22 | 0.2 | 1.25 | 0.2 | 0.003 |

LIST OF REFERENCE SYMBOLS

1—blank
2—device for heating
3—forming device
4—spatially shaped drawn part
5—deep drawing equipment
6—roll straightener

The invention claimed is:

1. A method of production of pressed sheet parts with integrated preparation of blanks of non-uniform thickness comprising the steps of:

heating a steel sheet blank in heating equipment to the austenite region of the steel of the sheet steel blank;

forming the blank into a flat semi-finished product of non-uniform thickness in forming equipment;

thereafter straightening the semi-finished product to eliminate shape deviations formed during the forming step, wherein said straightening is performed without further heating of the semi-finished product;

transferring the semi-finished product to deep drawing equipment without further heating of the semi-finished product;

thereafter deep drawing without further heating of the semi-finished product in the deep drawing equipment into a final spatially shaped part; and cooling the final spatially shaped part either during the drawing step or immediately after the drawing step in a manner which causes it to develop hardening microstructure.

2. The method of production of pressed sheet parts with integrated preparation of blanks of non-uniform thickness according to claim 1, wherein the forming step includes rolling the blank and the flat semi-finished product is a sheet semiproduct of non-uniform thickness, and including the step of hot straightening the sheet semiproduct of non-uniform thickness in a roll straightener prior to the deep drawing step.

* * * * *